US010765188B2

(12) United States Patent
Van Geer

(10) Patent No.: US 10,765,188 B2
(45) Date of Patent: Sep. 8, 2020

(54) KEY WALLET BUTTERFLY TYPE

(71) Applicant: René Johan Van Geer, Rijswijk (NL)

(72) Inventor: René Johan Van Geer, Rijswijk (NL)

(73) Assignee: R.J. VAN GEER BEHEER BV, Rijswijk (NL)

( * ) Notice: Subject to any disclaimer, the term of this patent is extended or adjusted under 35 U.S.C. 154(b) by 0 days.

(21) Appl. No.: 16/451,726

(22) Filed: Jun. 25, 2019

(65) Prior Publication Data

US 2019/0313755 A1 Oct. 17, 2019

Related U.S. Application Data

(63) Continuation of application No. 16/314,267, filed as application No. PCT/NL2017/050436 on Jun. 30, 2017.

(30) Foreign Application Priority Data

Jun. 30, 2016 (NL) ..... 2017082
Jun. 29, 2017 (NL) ..... 2019150

(51) Int. Cl.
*A45C 11/32* (2006.01)
*A45C 13/00* (2006.01)

(52) U.S. Cl.
CPC ..... *A45C 11/32* (2013.01); *A45C 13/005* (2013.01)

(58) Field of Classification Search
CPC ..... A45C 11/32; A45C 13/005; A45C 11/00; A45C 11/24; Y10T 70/8676
USPC ..... 206/38.1, 266, 38, 37.1, 5, 5.1, 6; 220/838
See application file for complete search history.

(56) References Cited

U.S. PATENT DOCUMENTS 1,187,852 A 6/1916 Leach
1,494,242 A 5/1924 Hill
2,793,741 A * 5/1957 Jerry ..... A45C 11/06 206/6
3,011,537 A * 12/1961 Manuel ..... A45C 11/32 206/37.8
3,205,531 A * 9/1965 Amos ..... A45C 5/02 16/258
3,301,430 A * 1/1967 Cornelius ..... A45C 13/005 312/405
4,033,162 A 7/1977 Fontana
4,228,836 A 10/1980 McFarland
(Continued)

FOREIGN PATENT DOCUMENTS

CH 596 796 A5 3/1978
DE 37 02 505 C1 2/1988
(Continued)

OTHER PUBLICATIONS

International Search Report and Written Opinion, dated Oct. 20, 2017, from corresponding PCT application No. PCT/NL2017/050436.

*Primary Examiner* — Chun Hoi Cheung
(74) *Attorney, Agent, or Firm* — Young & Thompson

(57) ABSTRACT

Disclosed is a wallet comprising two shell halves which are associated by a rigid spine to open and close the wallet, and containing a bunch of keys, anchored to the wallet. The wallet is biased to the open position by a pre tensioned skin which covers windows in the two shell halves. The skin allows temporary outward bulging by elasticity, and immediately springs back into the initial unloaded state at the time the bulging load is removed.

20 Claims, 7 Drawing Sheets

(56) References Cited

U.S. PATENT DOCUMENTS

| | | | | | |
|---|---|---|---|---|---|
| 4,881,636 | A * | 11/1989 | Oletzke | A45C 11/32 | 206/37.1 |
| 5,121,834 | A * | 6/1992 | Tissembaum | A45C 11/24 | 206/1.5 |
| 5,168,984 | A * | 12/1992 | Walsh | A45C 11/323 | 206/37.5 |
| 5,730,310 | A * | 3/1998 | Yoshihara | A45C 13/005 | 16/225 |
| 5,950,814 | A * | 9/1999 | Lindberg | A45C 11/24 | 206/6 |
| 7,665,625 | B1 * | 2/2010 | Rothstein | A45C 13/00 | 220/263 |
| 2007/0062964 | A1 * | 3/2007 | Kampf | B65D 43/162 | 220/835 |
| 2016/0101909 | A1 * | 4/2016 | Schennum | A45C 13/007 | 206/266 |
| 2017/0000232 | A1 * | 1/2017 | Scicluna | A45C 13/04 | |

FOREIGN PATENT DOCUMENTS

| | | | |
|---|---|---|---|
| EP | 1243198 | A1 | 9/2002 |
| GB | 877 325 | A | 9/1961 |
| GB | 2471197 | A | 12/2010 |
| WO | 96/32858 | A1 | 10/1996 |

* cited by examiner

KEY WALLET BUTTERFLY TYPE

BACKGROUND OF THE INVENTION

(1) Field of the Invention

This invention relates to a wallet for storing keys or similar articles (hereafter commonly called "key"). A key means here a typically metal article, usually elongated, to be gripped manually and inserted in a key hole of the door of a house or car, for locking and unlocking the door by turning the inserted key clockwise or anti clockwise.

(2) Description of Related Art

Prior art key wallets are e.g.: GB877325A, U.S. Pat. No. 1,187,852A, CH596796A5, DE3702505C1, EP1243198A1, U.S. Pat. No. 1,494,242A and many others.

BRIEF SUMMARY OF THE INVENTION

The words "elastic", "resilient", yield", are mainly used to explain that the element or material can expand in length and/or width, like a rubber or elastic band.

The object of the invention is versatile and may be one of more of: comfortable to use; operation by a single hand; intuitive operation; safe operation; reliable operation; long life; suited for mass production; environmental friendly; limited number of parts; compact storage and/or transport in large numbers; compact size; tight fit around both a single or a small number and a large number of keys; trousers pocket size; attractive appearance; easy to repair; easy to recycle; protects keys against damage due to keys slamming against each other while carried around in the trouser pocket; avoids the noise of a rattling key bundle; allows storage of oversized, particularly extremely long, keys; allows easy selection of a single key from a key bundle; allows a single key operatively outside the wallet while the remaining keys of the bundle are stored within the wallet; provides easy access to the stored keys; ease of removing or adding a key to the bundle; the key bundle moves easily in and out the wallet by a simple movement of the user, e.g. his hand or wrist; allows safe storage of a fragile article, e.g. cigarette, in addition to keys; can be used as a toy or excercising implement, e.g. percussion or trampoline for small objects; protects other articles, e.g. mobile phone or money wallet carried in the same pocket or bag against damage, e.g. scratches or wear, caused by keys, and the pocket or bag itself; allows one or more keys attached to the wallet to be outside the wallet while the wallet is closed; a size sufficient small to fit in a single hand, e.g. approximately credit card format.

The wallet of the invention preferably comprises two shell elements, e.g. halves (also called panels) which are associated by connection means such that they can move relative to one another such that a part of the one shell element, e.g. boundary edge, can move away from the corresponding part of the other shell element to open and close the wallet. Preferably this is by pivoting or swiveling or rotating movement of one or both the shell elements, however a translating movement or the combination of two or more of these movements is also feasible.

Preferably the wallet provides a container the edges and/or sides (also called minor faces) of which are rigid, e.g. provided by a rigid frame, while one or both opposite main faces allow resilient deflection to e.g. repeatedly move between the unloaded flat shape and a bulged shape caused by a load, e.g. the wallet contents, acting perpendicular to the main face. Thus, when hand held, the closed wallet feels solid while at the same time a main face can be squeezed like a sponge by the finger tips and the enclosed key can be sensed through the main face. The solid sense is due to the fixed length and width and thickness provided by the rigid edges.

Preferably the wallet has one or more external wall parts covered or provided by a skin (also called membrane or foil or cloth). The skin can be provided by a single material type or by two or more material types, e.g. located next to each other as e.g. strips, e.g. mutually joined by a seam or seamless joint.

Preferably the wallet in the unloaded, closed position provides the image of a container having flat and/or smooth main faces, while when packed with a stack of keys beyond the original thickness (i.e. the wallet thickness if unloaded) of the closed wallet, one or both main faces are bulged outward, and preferably in both cases the wallet is closed along its external edges, apart from a possible gap between parts that mutually move for opening the wallet.

The elastic behavior of the skin, or part of it, provides that if the skin is pulled taut across the opening of a drum, like the sheet of a percussion drum, and locally a force normal to the skin is applied, e.g. a finger tip, a local indentation is created and if the force is removed, the skin will immediately spring back or rebound. Typically, the skin will deflect such that the contour of the object, e.g. key, loading the skin, will be visible at the opposite face (in other words the skin obtains a relief making the object visible through the skin by a coining or embossing effect).

The wallet can, by way of example, comprise a rigid spine (also called hinge or pivot) providing a pivot axis designed for opening and closing the wallet, two shell elements extending from the spine such that they are hingedly connected at the spine, e.g. similar to the front and back face of a book, which shell elements have a fixed length and width.

One or more of the following applies to the skin or part of it: yields or stretches resiliently or elastically, preferably at least 5 or 10 or 20 or 30 or 50 or 100 or 200%; elastic bias 10 or 8 or 6 or 5 or 4 or 3 or 2 or 1.5 Newton at the most and/or at least 0.1 or 0.25 or 0.5 Newton for 1 millimeter yield for a sheet of 100 millimeter length and 100 millimeter width; stretched or pre tensioned when wallet is opened and/or closed, preferably at least 2 or 5 or 8 or 10% yield; stretch or pre tension increases while moving from opened to closed of the wallet, preferably the increase is at least 2.5 or 5 or 7 or 10%; different from natural leather or tensile rigid (non-stretch) fabric or woven or non-woven; at least 10% more elastic yield compared to natural leather or tensile rigid (non-stretch) fabric or woven or non-woven; thickness at least 0.25 or 0.5 or 0.8 or 1.0 or 1.3 and/or maximum 1.7 or 2 or 2.5 or 3 or 5 millimeter, e.g. approximately 1.5; anisotropic yield, preferably at least 5 or 10 or 15 or 20 or 50% different or substantially absent (substantially non-stretch) in the one direction, preferably maximum yield perpendicular to the wallet pivot axis; made of elastic like or rubber like material or rubber or latex or neoprene or woven or knitted or braided from elastic yielding yarns; provides the means to bias the wallet to the open position; air and/or water permeable or impermeable; non-slippery surface; extends at both sides of the wallet pivot axis; completely covers the pivoting wallet panels, preferably externally; easy pleadable and/or foldable, preferably elastically; substantially resistant against permanent deformation, e.g. pleads and/or folds and/or wrinkles; a permanent deformation, e.g. one or more of plead, fold or wrinkle, is absent; sheet or foil or membrane or cloth or textile like; puncture resistant;

water resistant; tear resistant; easily conforms its shape elastically to contents of wallet; approximately rectangular shape; a dimension approximately twice the holder width; partly made from substantially non-elastic or non-stretch material or substantially less elastic material, e.g. natural leather or cloth; one or more of wrinkle free, fold free and plead free, in the open and/or closed position of the unloaded wallet, at least in the area covering the window; provides one or more of flat, smooth and level faces of the unloaded wallet in its open and/or closed position, at least in the area covering the window.

One or more of the following applies to the housing: thin walled; shaftless pivot; pivot axis extends along longer side; two mutually pivoting panels, preferably providing opposite main faces; panels have snap fit at the pivot; panels have integrated hinge parts to provide the pivot; at least one panel comprises a rigid space frame and/or one or more openings; space frame delimits a single opening; space frame provides the outer edges; space frame provides a cadre or framework or is circumferential; space frame is U-shaped and its distal leg ends are joined with the spine; a panel comprises metal, e.g. plate metal, e.g. the space frame of the panel, or part of it, comprises metal, e.g. plate metal; a panel is covered by a skin; an opening (also called window) is closed by a skin; the opening or openings associated with a main face or panel makes at least 50 or 60 or 70 or 80 or 90% of the surface area of the main face or panel; rectangular shape; length at least twice width; thickness (in unloaded, closed condition) not more than 20 or 25% or 50% or 75% of width; thickness (in unloaded, closed condition) at least 5 or 10 and/or not more than 20 or 25 or 30 millimeter; thickness (i.e. measured from the one to the opposite main wall) of the internal space (in unloaded, closed condition) at least 5 or 10 and/or not more than 20 or 25 or 30 millimeter (the objects, e.g. keys, are housed in the internal space); elongated; length at least 50 or 80 or 90 millimeter and/or maximum 110 or 120 millimeter, e.g. approximately 100 millimeter; width at least 30 or 40 millimeter and/or maximum 50 or 60 millimeter, e.g. approximately 45 millimeter; at least three or four of its external edges is rigid (in the closed condition the wallet has four edges if rectangular shaped); biased to the open position by the skin and preferably also biased to further open if in the completely open position wherein further opening is e.g. blocked by a stop means of the wallet; stop means is integrated in hinge; a key retaining or connection means (in here also called "chain"), preferably to engage the aperture in the grip of the key (the "grip" means the part of the key which is held between thumb and indexing finger if the key is inserted in the key hole), e.g. comprising a key ring or loop and/or a flexible tension member, e.g. chain, which carries the keys; chain length at least 50 or 75% of holder length; at least one chain end temporary fixed, e.g. by snap fit, to the housing, e.g. to add or remove a key or for safety (e.g. in case of an accident; chain length at least 25 or 50% or 75% or 100% longer than shortest distance between its to the holder anchored ends; a chain end anchored to a panel edge, preferably a short edge, e.g. approximately midway; a chain end anchored at or near the pivot; each chain end anchored to a proper panel; single chain carries all keys; elastic or non elastic chain; elastic expandable storage space, e.g. at least 50% or 100% or 150% expansion of the thickness; storage space boundary provided by holder external wall, e.g. skin; expansion of storage space provides equal expansion of holder volume; panels mutually engaged by hooking parts at the pivoting edge of both panels; pivoting edges of panels pressed against each other by bias of skin; panels loose laying against each other at pivoting edge; panel edges at pivot have mutual form fit; panel edges at pivot can be immediately moved from each other against skin bias; pivoting shell halves providing panels; in the closed position at least one side provides a gap of at least 2 or 3 or 4 or 5 millimeter, preferably one or two sides at the most provides such gap, preferably for substantially or at least 50 or 75% its complete length; a short side provides the gap; operating button for unlocking the shell halves near or at a corner or midway an edge length and/or at a long or short edge; operating button located between and/or projecting outward from between panels; operating button externally accessible while wallet closed; operating means, e.g. button actuates lock release, preferably provides translating movement of lock part; transmission means associated with operating button to actuate lock; button operated by pushing or turning action, e.g. of finger or thumb of user; translating or turning button; opening angle limited to less than 120 or 110 or 100 or 90 or 80 or 70 degrees, preferably by limiting or stop means, e.g. at the pivot; opening angle at least 45 or 60 degrees; skin provides elastic force to resiliently open the holder by pivoting from the closed position, provides at least 80 or 90 or 95% of the surface area of one ore both main faces of the holder and/or keeps the panels in biased engagement; skin attached by e.g. clinching or clamping, preferably to frame at preferably a single edge of a panel; skin, preferably merely, anchored to frame at opposite edges, preferably both long edges or edges parallel to pivot axis; pivot comprises an inner partly cylindrical wall at pivot edge at the one panel tightly nested within an outer part cylindrical wall at pivot edge at the other panel, said partly cylindrical walls slidingly engage mutually in the pivot direction; the outer cylindrical wall has a stop edge associated with a stop edge at the inner cylindrical wall to limit pivoting towards the open position; skin provides a, preferably loose, envelope or hull or wrapping of the holder; skin pre tensioned or pulled tight in open and/or closed position of wallet; skin pre tensioned or pulled tight in open position at least 1 or 2 or 3 or 4 or 5 or 6 or 7 or 8 or 9 or 10% yield; skin provides external surface; lock provides rigid and/or internal locking; lock is provided internal; lock holds opposite edges fixed or rigidly against bias to the wallet open position; lock is releasable by releasing means, preferably operated by operating means, e.g. through transmission means; lock provides mutually engaging snapping and/or hooking parts in the closed position; locking parts are provided at both panels, preferably at an outer edge, preferably long edge, preferably midway; in the closed position the shell halves are one or more of: stacked onto each other, located right above each other, parallel to each other, keep the wallet closed; the skin covers the complete external surface of the two wallet main faces; if closed the wallet comprises two external, opposite main faces spaced by the wallet thickness; thickness can be resiliently or elastically expanded to at least two or three or four times the original thickness; a releasable lock to selectively keep the wallet closed, preferably of internal type; in closed, unloaded condition an elongated, flat walled, sleeve like shape; the two panels are merely mutually connected at the spine; the two panels mutually connected along one edge and are mutually free along the other three edges; in closed and/or open condition its inside is accessible through three sides and not through the fourth side; the edges at the short minor faces are merely mutually connected at the pivot; at least one of the edges that move away from each other while the wallet opens, have towards each other extending parts, e.g. to provide attachments means for the skin (e.g. to clinch the skin).

For the key retention means of the wallet, e.g. the chain, one or more of the following applies: holds preferably at least two, three, four, five or six keys; can move, preferably free, e.g. by virtue of gravity or movement of the wallet, between a retracted position, in which the associated keys are stored within the wallet, and an extended position, in which one or more of the associated keys are external from the wallet and possibly one or more other associated keys are stored within the wallet; in the extended position at least part of the chain, e.g. at least 20 or 30 or 60 or 80% of it, projects outside the wallet; in the retracted position the chain is completely within the wallet or not more than 5 or 10% of it is outside the wallet; is hingedly connected to the wallet for the movement between extended and retracted position; attached to the housing; elongated; merely a single connection point with the housing; comprises a rigid elongated member, e.g. rod.

The wallet preferably is provided by two opposite main faces, two opposite long minor faces and two opposite short minor faces, wherein the minor faces provide the wallet thickness. A long minor face meets a short minor face at an angle of 90 degrees. Preferably, if closed, the long minor faces are tight such that they do not allow a key to pass and/or one or both the short minor faces delimit an opening for a key to pass.

BRIEF DESCRIPTION OF THE SEVERAL VIEWS OF THE DRAWINGS

The attached drawing illustrates presently preferred embodiments without limiting the scope of protection, showing in.

DETAILED DESCRIPTION OF THE INVENTION

Figure 1:
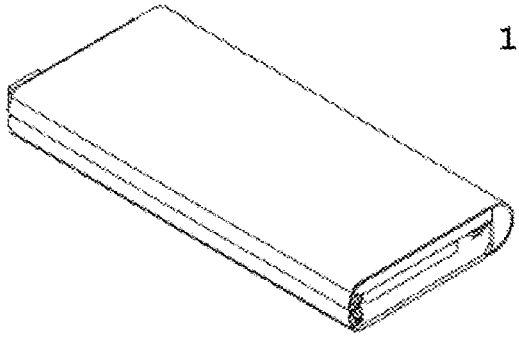
FIGS. 1 and 2 the closed wallet from the opposite sides, in perspective view.
Figure 2:
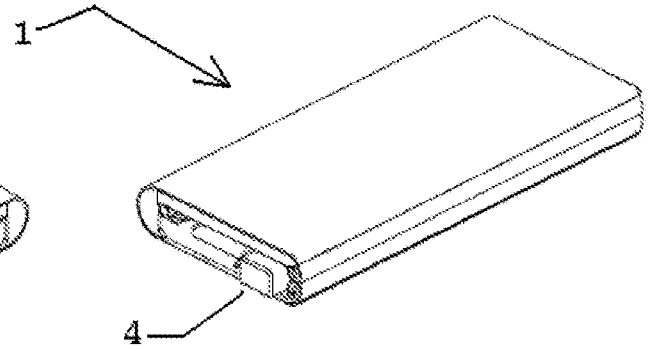

Meaning of the reference signs: wallet 1, key 2, aperture 3 in key grip, operating button 4 of lock, main face or side 5, chain 6, space frame 7, latch 8 of lock, quick connector 9 of chain 6, hooks 10 of lock, spine or pivot 11, foil 12 (also called membrane or skin), clinch edge 13, stop 14 limiting the opening angle, window 15 inside the space frame 7.

FIG. 1-8 show the two space frames, the outer envelope of rubber like foil material, also called skin, the operating button associated with the lock, the key chain, a key, the quick connector associated with the one chain end.

Figure 3:
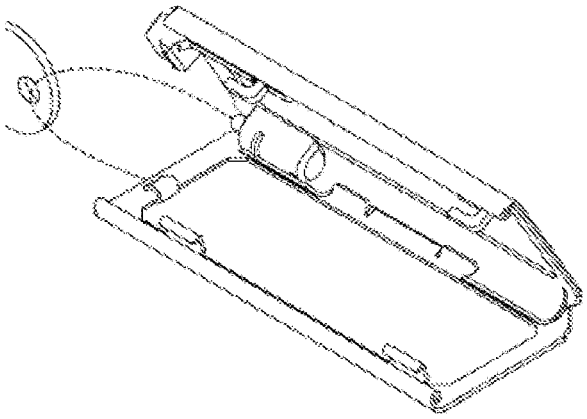
FIGS. 3 and 4 the open wallet from the opposite sides, in perspective view, and associated chained key presented.
Figure 4:
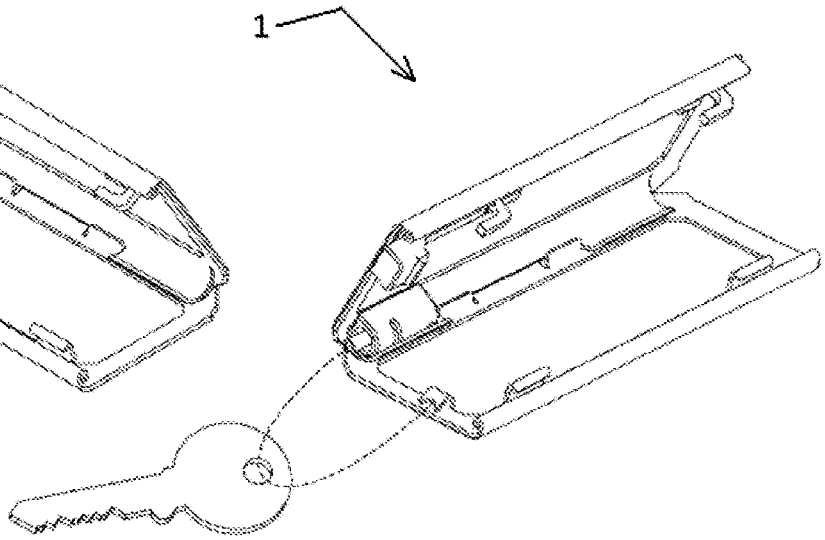
Figure 5:
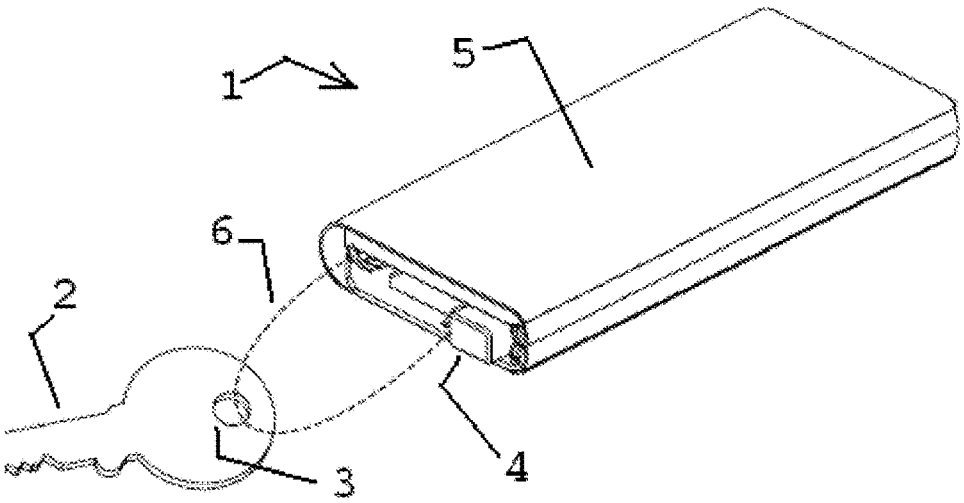
FIG. 5 the closed wallet in the view similar to FIG. 4, and associated chained key presented.
Figure 6:
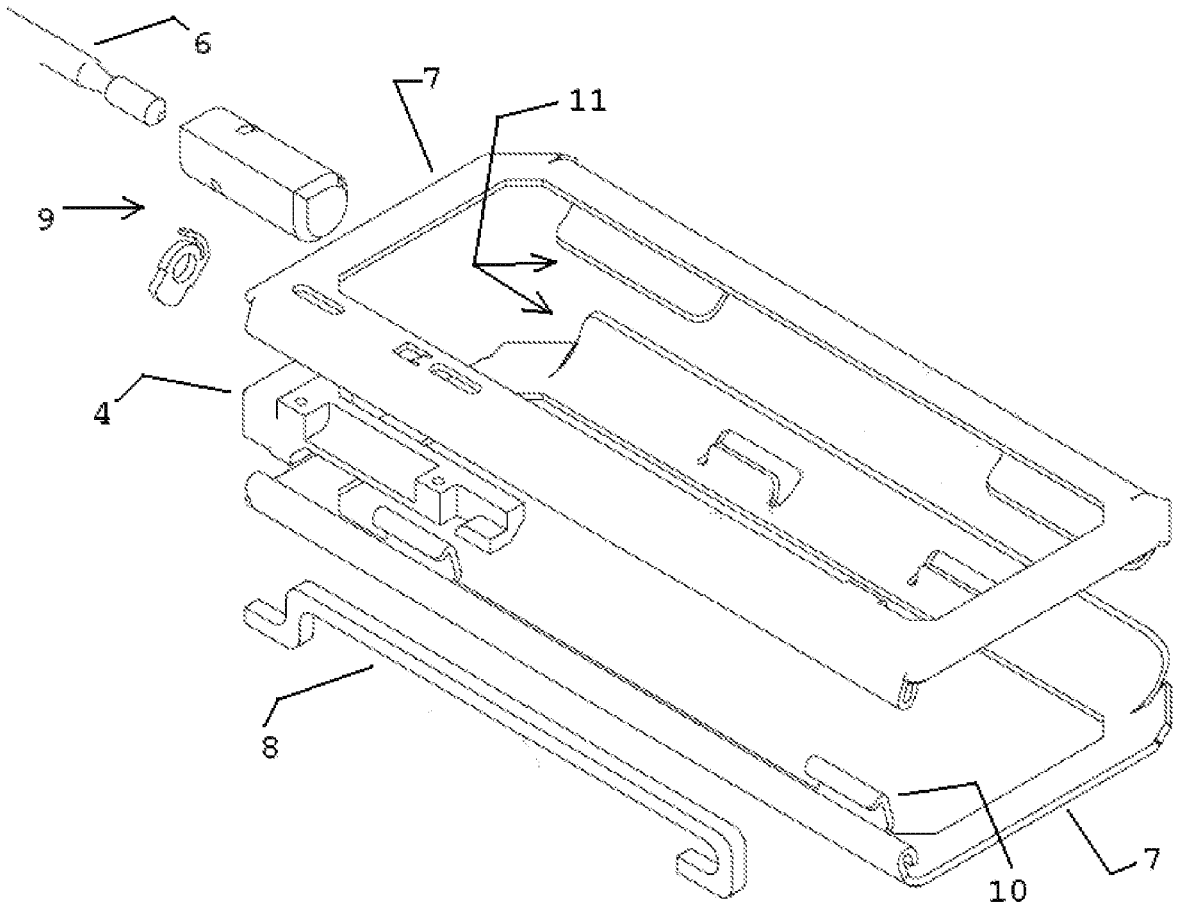
FIG. 6 an exploded perspective view, skin removed, of the main components of the wallet, in closed position.
Figure 7:
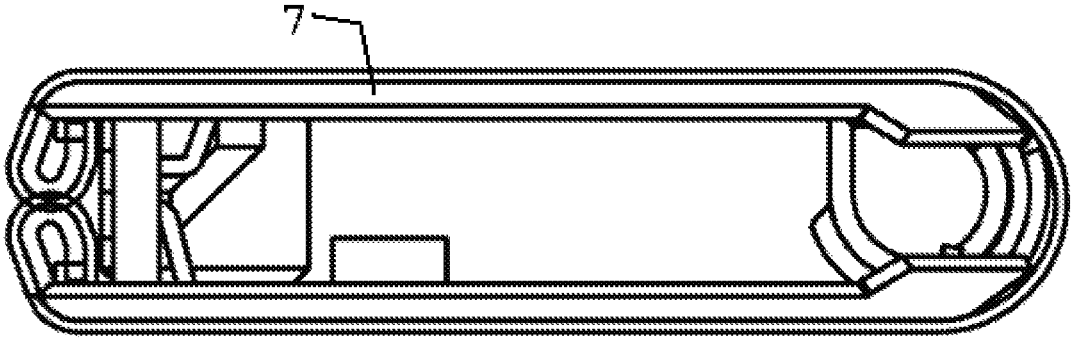
FIG. 7 an end view of the wallet shown in FIG. 1.
Figure 8:
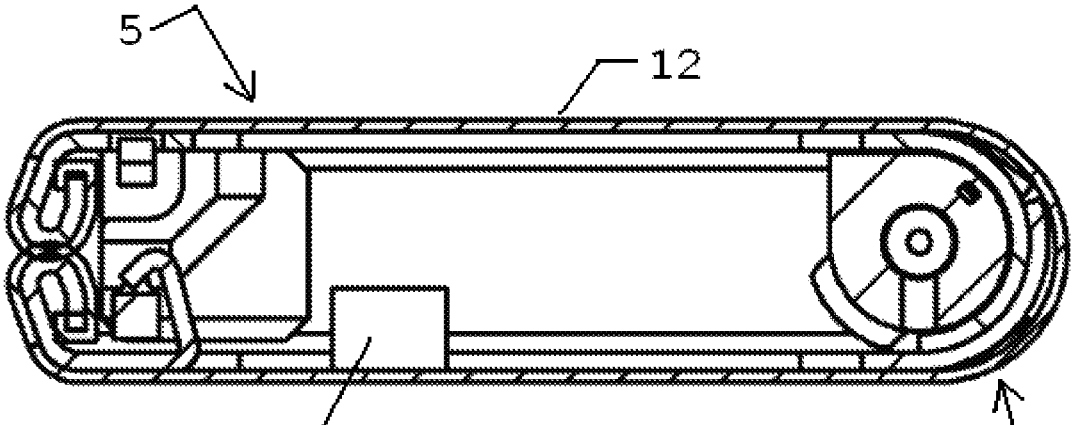
FIG. 8 a sectional view of the wallet shown in FIG. 1.

In the closed wallet position, see e.g. FIG. 1, the longitudinal edges of the superposed panels distal from the pivot axis are near each other while in the open wallet position, see e.g. FIG. 3, these edges are moved away from each other. Also if the closed wallet is packed with keys such that the main faces bulge outwardly, these distal edges are kept in the position shown in FIG. 1 by the rigid hooking parts of the internal lock.

The wallet is provided by two opposite main faces, two opposite long sides and two opposite short sides. A long side meets a short side at an angle of 90 degrees. If closed, the long sides are tight such that they do not allow a key to pass, however the short sides delimit an opening for a key to pass.

Figure 9:
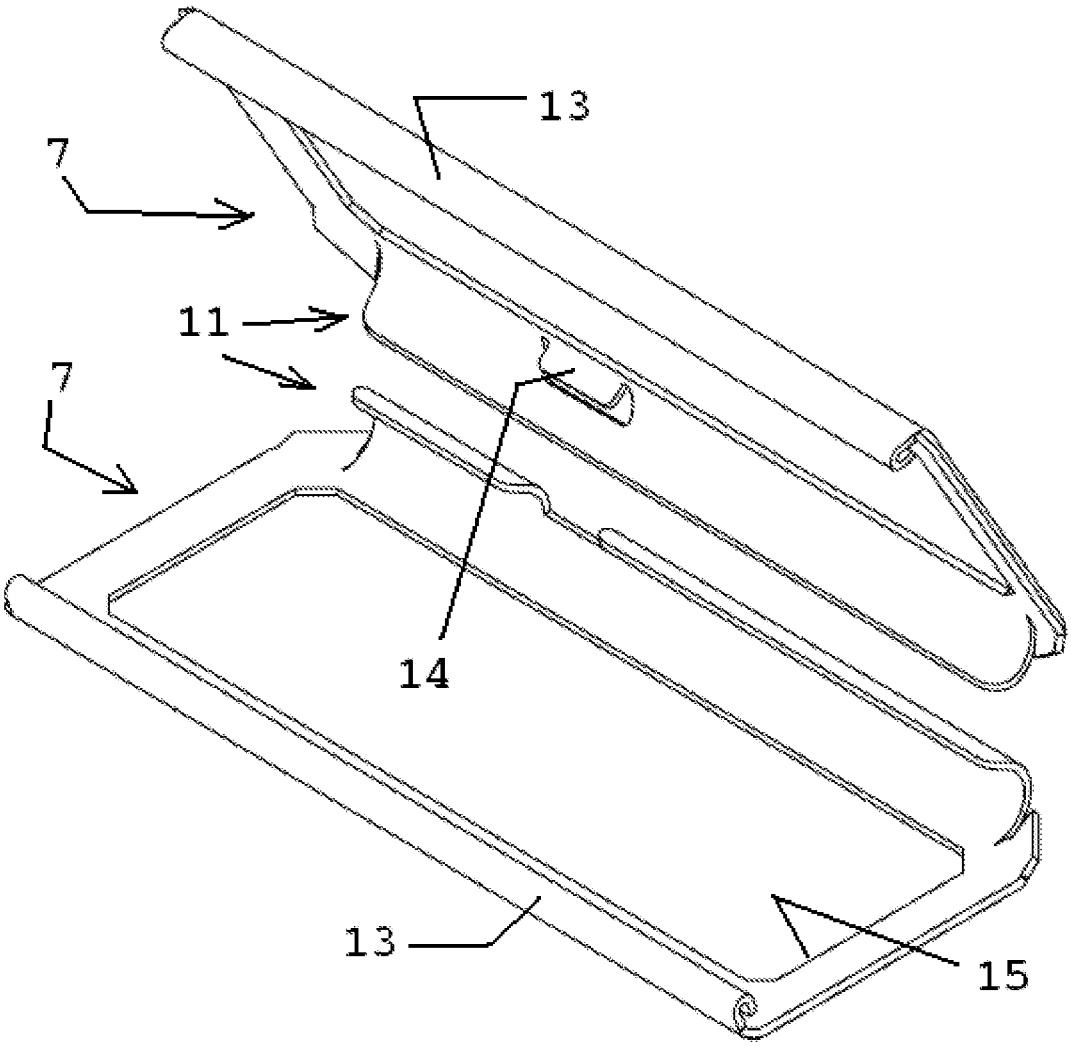
FIG. 9 an exploded perspective view of the space frames of the pivoting panels, in open position.
Figure 10:
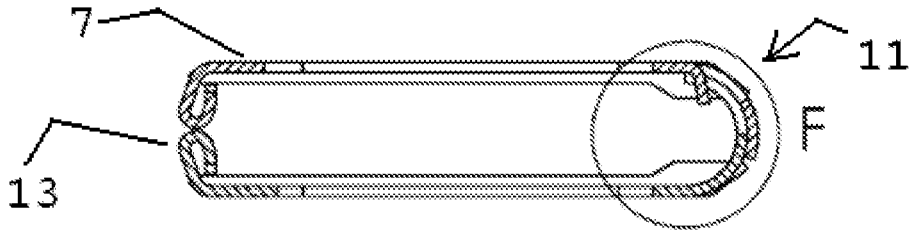
FIG. 10 a sectional view of the assembled space frames, in closed position.
Figure 11:
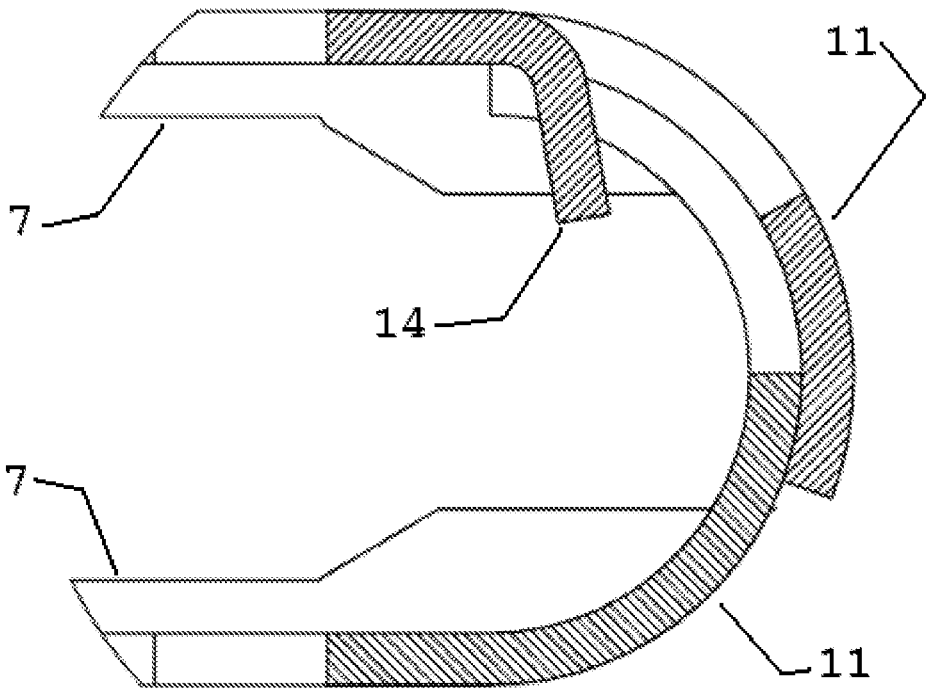
FIG. 11 detail F of FIG. 10 (scale 5 to 1)
Figure 12:
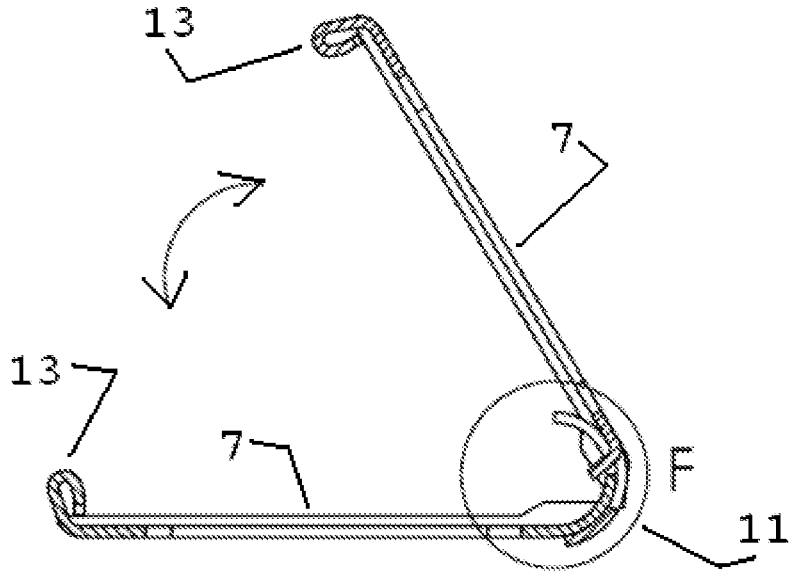
FIG. 12 a sectional view of the assembled space frame, in open position.
Figure 13:
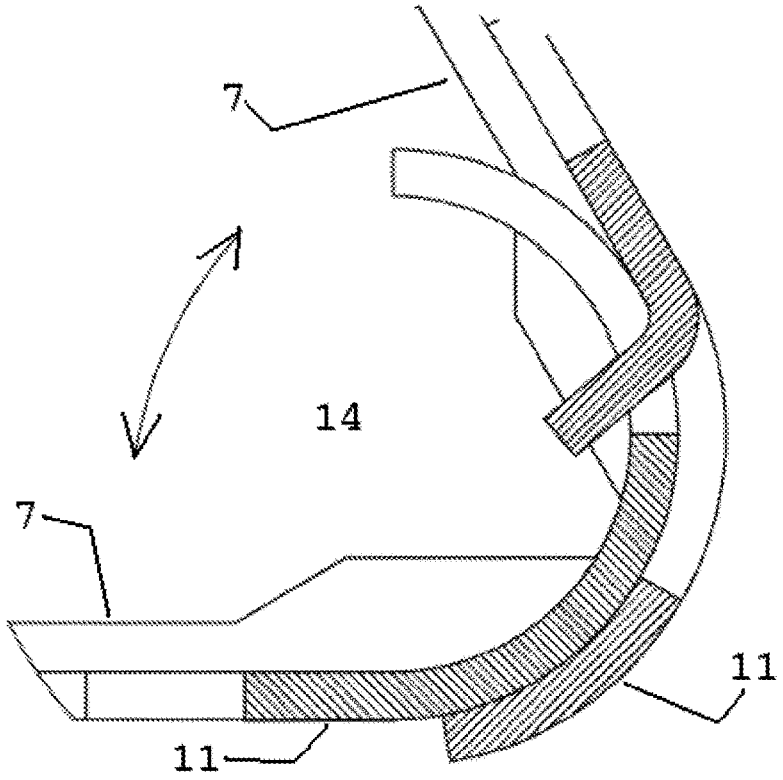
FIG. 13 detail F of FIG. 12 (scale 5 to 1)

FIG. 9 provides details of the pivoting edges of the panels and of the opposite edges to which the skin is clinched. Compared to FIG. 6 the features of the lock are absent and the pivoting edges are designed differently.

FIG. 10-13 provide details of the form fit of the pivot edges and associated stop elements to limit the opening angle. The skin is absent.

Figure 14:
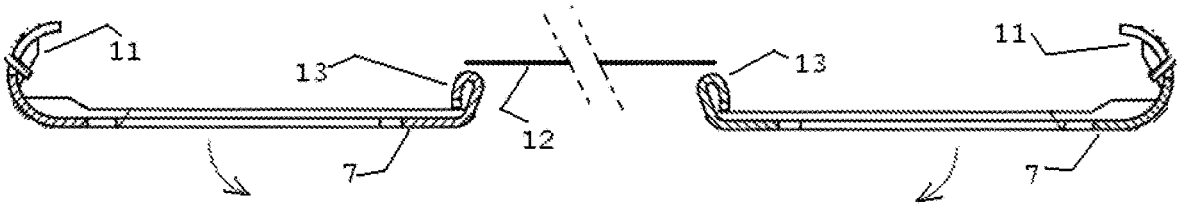
FIG. 14-16 successive steps during assembly of the wallet in sectional view.
Figure 15:
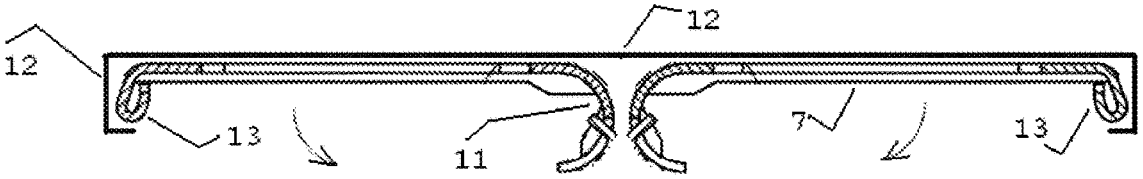
Figure 16:
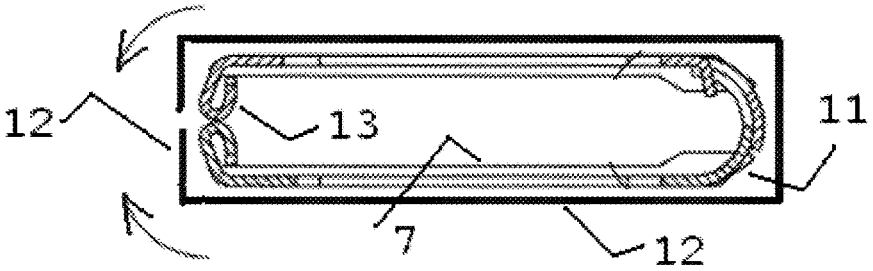

FIG. 14 shows the skin clinched to both panel edges and by turning the panels according to the arrows, the position of FIG. 15 is obtained. Starting from FIG. 15, by turning the panels according to the arrows, the position of FIG. 16 is obtained, in which the pivot edges are engaged by form fit and biased in engagement by the permanently stretched envelope.

Figure 17:
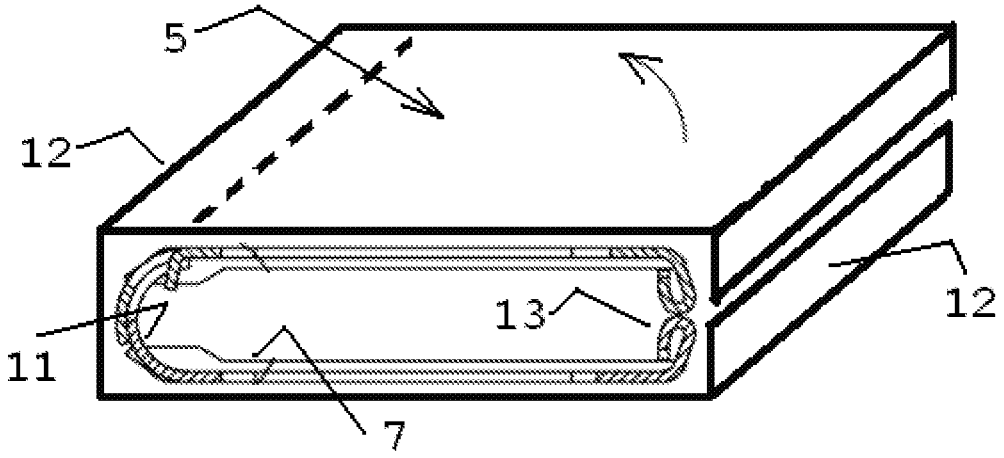
FIG. 17 a perspective view of the completed wallet.

FIG. 17 schematically illustrates the skin providing an envelope for the wallet, shown in closed position, and discontinued along the line where the distal panel edges meet.

Figure 18:
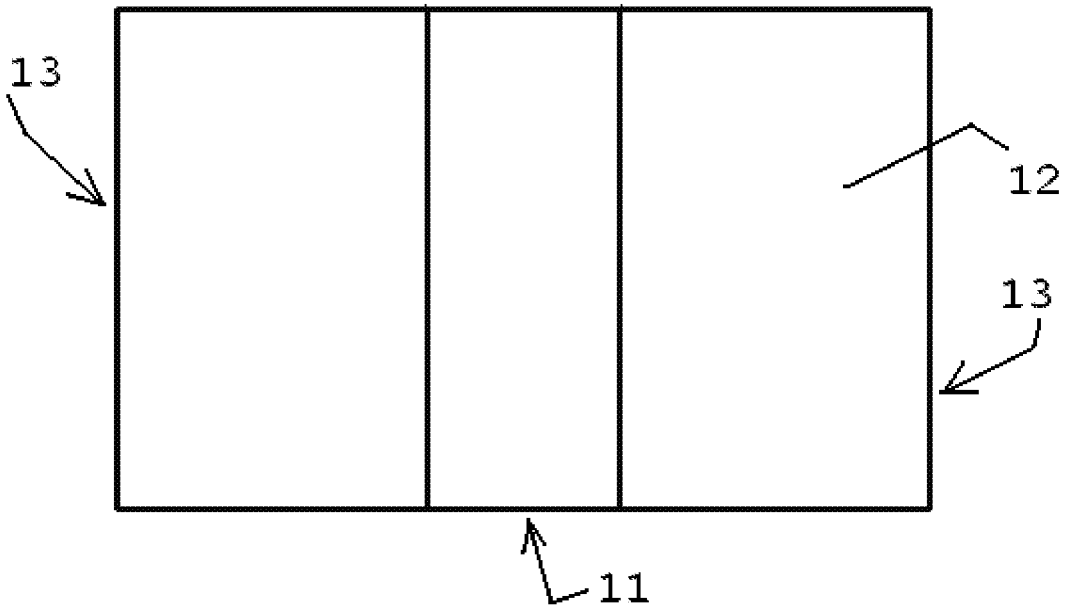
FIG. 18 an embodiment of the skin.

FIG. 18 shows a skin made from two material types. The central strip is elastic, thus highly resiliently stretchable, and the fields at both sides are from natural leather, thus substantially stretch free. The elastic central strip will be registered with the pivot axis of the wallet. If applied to the wallet of FIG. 17, the seam between the central strip and a natural leather field could be located at the dotted line.

The drawing illustrates both panels providing part of the means for hinged connection. Alternatively a living hinge is feasible, or one of the panels provides substantially the hinge, e.g. as a spine. The lock could comprise magnetic means.

The drawing, the specification and claims contain many features in combination. The skilled person will consider these also individually and combine them to further embodiments. Also different embodiments belong to the invention. Features of different in here disclosed embodiments can in different manners be combined and different aspects of some features are regarded mutually exchangeable. All described or in the drawing disclosed features provide as such or in arbitrary combination the subject matter of the invention, also independent from their arrangement in the claims or their referral.

The invention claimed is:

1. Wallet, having four wallet boundary edges, comprising two shell elements which are associated by connection means at a spine of the wallet in such a manner that they are configured to pivot relative to one another around a pivot axis at the spine such that a first longitudinal boundary edge of the one shell element, is configured to move away from a corresponding first longitudinal boundary edge of the other shell element to move between an open and a closed position of the wallet by mutually pivoting of the shell elements, wherein a pre tensioned membrane material extends from the one shell element via the spine to the other shell element and biases the shell elements to pivot in the direction from the closed to the open position of the wallet, both if the wallet is in the open and closed position, and each shell element provides a main face of the wallet and further pivoting, due to the bias of the pre tensioned membrane material, of the shell elements in the direction from the closed to the open position of the wallet, beyond the open position of the wallet is blocked by a stop means of the wallet.

2. The wallet according to claim 1, comprising an open position and a closed position, in the closed position providing an elongated sleeve like shape, in the completely open position of the wallet the shell elements make a mutual angle limited to less than 120 degrees, the shell elements are merely connected to each other along a second longitudinal boundary edge, also providing a hinged connection providing a rigid spine, in the closed position an inner space of the wallet is open to the environment via three of four wallet boundary edges, which four wallet boundary edges provide a rectangular shape when viewing towards one of the main faces of the wallet, the wallet moves between the open and closed position by pivoting of the shell elements at the spine, wherein the wallet boundary edge provided with the spine is the only wallet boundary edge that seals the wallet from the environment.

3. The wallet according to claim 1, containing a bunch of metal house door keys, which bunch is anchored to the wallet by retaining means, which retaining means is configured to move between a retracted position, in which the retaining means and the bunch of keys are completely within the wallet, and an extended position, in which part of the retaining means and the complete bunch of keys project outside the wallet, the wallet is configured to be in the closed position both when the retaining means are in the retracted position and the retaining means and the bunch of keys are completely inside the wallet, and in the extended position when part of the retaining means and the complete bunch of keys are outside the wallet.

4. The wallet according to claim 1, at least one of the shell elements has a first area allowing temporary outward bulging by elastic deformation of the membrane material, which area is delimited, completely circumferentially, by rigid boundaries, such that said area immediately springs back into the initial unloaded state at the time the bulging load is removed.

5. The wallet according to claim 3, wherein the wallet is designed such that the assembly of retaining means and bunch of keys is allowed to move between the retracted and extended position merely when the wallet is in an open position.

6. The wallet according to claim 1, wherein the membrane material provides an elastically resilient foil covering both shell elements and extending from the one shell element to the other shell element via the spine and being pre tensioned by at least 5% yield both in the closed and open position of the wallet such that both in the open and closed position of the wallet the pre tensioned membrane material biases the shell elements in the direction of moving from the closed to the open position of the wallet.

7. The wallet according to claim 4, at least one shell element comprises a space frame of rectangular shape which provides the boundary edges of the shell element and also provides the external boundaries of a window of said shell element which window provides said first area and is covered by said membrane material such that the wallet has rigid wallet boundary edges and has main faces that, in the area of the window, are configured to be outwardly bulged by bulky contents within the closed wallet.

8. The wallet according to claim 6, the foil is fixedly attached to the first longitudinal boundary edges of the shell elements that are located opposite the second longitudinal boundary edges that are hingedly connected at the spine and the foil lays loose at the other boundary edges of the shell elements.

9. The wallet according to claim 1, wherein the membrane material has a rectangular shape, is pre tensioned such that the membrane material is elastically yielded for at least 10%, is wrinkle free, is easy pliable and foldable, and has a dimension in the direction parallel to the orientation of the pivot axis, which orientation is parallel to the first and second longitudinal boundary edges of the shell elements, equal to or not more than the dimension of the shell element in the same orientation.

10. The wallet according to claim 1, the membrane material provides a foil that allows an elastic yield of at least 100% and provides an elastic bias of at least 0.5 Newton and not more than 5 Newton for 1 millimeter yield for a sheet of 100 millimeter length and 100 millimeter width, the foil thickness is at least 0.25 and not more than 1.7 millimeter, the foil allows an elastic yield in the one direction parallel to the face of the foil that is at least 50% different from the elastic yield in the perpendicular direction parallel to the face of the foil, such that the foil has an anisotropic yield behavior, wherein the direction in which the foil allows lowest yield is parallel to the wallet pivot axis and the foil is woven, knitted, or braided from elastic yielding yarns.

11. The wallet according to claim 1, wherein the membrane material is woven, knitted, or braided from elastic yielding yarns.

12. The wallet according to claim 1, wherein the stop means is associated with the spine and is configured to limit the opening angle of the shell elements to less than 90 degrees.

13. The wallet according to claim 1, the spine provides a hinge which is shaft less and the shell elements have second longitudinal boundary edges at the hinge shaped such that they have mutual form fit to allow the pivoting movement of the shell elements at the spine and the second longitudinal boundary edges have a loose mutual engagement at the spine and are kept in mutual engagement and are kept pressed against each other, while fitting into each other, by the bias of the pre tensioned membrane material.

14. The wallet according to claim 6, containing a bunch of metal house door keys providing a stack thicker than the thickness of the empty, closed wallet, wherein when hand held, the closed wallet feels solid while at the same time a main face is configured to be squeezed like a sponge by the finger tips and the enclosed keys are configured to be sensed through the main face while the solid sense is due to the fixed length and width and thickness provided by the rigid wallet boundary edges while the wallet in the empty, closed position provides the image of a container having flat and smooth main faces, while when packed with said bunch of keys one or both main faces are bulged outward and the foil is such that, when the wallet is packed with said stack of keys, the foil obtains a relief making the bunch of keys visible through the foil by a coining or embossing effect of the foil by the keys.

15. The wallet according to claim 3, wherein the bunch of keys is absent.

16. The wallet according to claim 1, having a length, parallel to the first and second longitudinal boundary edge, between 80 and 120 millimeter, a width, perpendicular to the first and second longitudinal boundary edge, between 30 and 60 millimeter and a thickness between 5 and 30 millimeter, when unloaded and closed.

17. The wallet according to claim 3 wherein the wallet is designed such that, starting from the closed position, the wallet is held in a single hand and an operating button of the wallet is operated by a finger of said hand such that a lock is released such that shell elements of the wallet, by the bias of the foil, automatically pivot to the open wallet position and are kept in said position by continued bias of the foil and then the retaining means are moved from the retracted to the extended position such that the retaining means and also the keys associated with the retaining means are brought outside the wallet and then, while the retaining means and associated keys remain outside the wallet.

18. The wallet according to claim 17, wherein the wallet is designed such that the retaining means are moved to the extended position by a wrist movement of said single hand while the wallet is in the open position.

19. The wallet according to claim 1 wherein the wallet boundary edge provided with the spine is the only wallet boundary edge that seals the wallet from the environment.

20. The wallet according to claim 1, configured to be closed against the bias of the pre-tensioned membrane material by squeezing the shell elements together about the pivot axis, wherein the pre tension of the membrane material increases at least 2.5% while moving from the open position to the closed position of the wallet.

* * * * *